US010407262B2

(12) United States Patent
Jess et al.

(10) Patent No.: US 10,407,262 B2
(45) Date of Patent: Sep. 10, 2019

(54) FABRIC POSITIONING APPARATUS

(71) Applicant: SHORT BROTHERS PLC, Belfast (GB)

(72) Inventors: Andrew Jess, Delta (CA); Paul Frazer, Holywood Down (GB); Lynsey Rebbeck Nee Bowman, Holywood Down (GB)

(73) Assignee: SHORT BROTHERS PLC, Belfast (GB)

( * ) Notice: Subject to any disclaimer, the term of this patent is extended or adjusted under 35 U.S.C. 154(b) by 519 days.

(21) Appl. No.: 15/104,403

(22) PCT Filed: Dec. 9, 2014

(86) PCT No.: PCT/GB2014/053644
§ 371 (c)(1),
(2) Date: Jun. 14, 2016

(87) PCT Pub. No.: WO2015/092364
PCT Pub. Date: Jun. 25, 2015

(65) Prior Publication Data

US 2017/0001817 A1 Jan. 5, 2017

Related U.S. Application Data

(60) Provisional application No. 61/918,293, filed on Dec. 19, 2013.

(51) Int. Cl.
*B65H 3/18* (2006.01)
*B65H 3/08* (2006.01)
(Continued)

(52) U.S. Cl.
CPC ..... *B65H 3/0883* (2013.01); *B65H 3/18* (2013.01); *B65H 5/08* (2013.01); *B65H 5/14* (2013.01);
(Continued)

(58) Field of Classification Search
CPC ..... B65H 3/08; B65H 3/0816; B65H 3/0883; B65H 3/18; Y10T 403/32681; Y10T 403/32704; Y10T 403/32737
See application file for complete search history.

(56) References Cited

U.S. PATENT DOCUMENTS 4,129,328 A * 12/1978 Littell ..... B65G 47/918 294/65
5,083,763 A * 1/1992 Hartta ..... B65H 3/0816 271/103
(Continued)

FOREIGN PATENT DOCUMENTS

CN 1970413 A 5/2007
CN 101119814 A 2/2008
(Continued)

OTHER PUBLICATIONS

International Search Report and Written Opinion dated Apr. 2, 2015, for International Patent Application No. PCT/GB2014/053644.
(Continued)

*Primary Examiner* — Thomas A Morrison
(74) *Attorney, Agent, or Firm* — Karceski IP Law, PLLC

(57) ABSTRACT

A positional adjustment apparatus for an attractor includes a positioning plate disposable at least adjacent to a surface of a mold, at least one drive operatively connected to the positioning plate to move the positioning plate and alter at least one of a first height, a first angle of tilt, a first lateral position, and a rotational position of the positioning plate with respect to the surface of the mold, at least one positioner disposed in an opening through the positing plate, the positioner hanging from and being moveable independently of the positioning plate, at least one attractor connected to the at least one positioner, and a joint disposed between the positioner and the positioning plate, the joint permitting the at least one positioner to change at least one of a second
(Continued)

height, a second angle of tilt, and a second lateral position with respect to the positioning plate.

13 Claims, 18 Drawing Sheets

(51) Int. Cl.
*B65H 5/08* (2006.01)
*B65H 5/14* (2006.01)

(52) U.S. Cl.
CPC .... *B65H 2511/10* (2013.01); *B65H 2511/234* (2013.01); *B65H 2701/1742* (2013.01)

(56) References Cited

U.S. PATENT DOCUMENTS

| | | | | |
|---|---|---|---|---|
| 5,622,362 | A * | 4/1997 | Shiiki | B65H 3/0816 271/106 |
| 6,343,639 | B1 | 2/2002 | Kaye et al. | |
| 6,863,323 | B2 * | 3/2005 | Neveu | B25J 15/0052 294/65 |
| 7,137,182 | B2 | 11/2006 | Nelson | |
| 7,228,611 | B2 | 6/2007 | Anderson et al. | |
| 7,364,616 | B2 * | 4/2008 | Tsuchiya | B65H 3/0816 117/2 |
| 7,611,601 | B2 | 11/2009 | Nelson et al. | |
| 8,088,236 | B2 | 1/2012 | Schendel et al. | |
| 8,114,241 | B2 | 2/2012 | Iagulli et al. | |
| 2002/0096815 | A1 * | 7/2002 | Dachtler | B65H 3/0816 271/3.11 |
| 2003/0063334 | A1 * | 4/2003 | Mandel | H04N 1/00607 358/498 |
| 2003/0063335 | A1 * | 4/2003 | Mandel | H04N 1/00607 358/498 |
| 2006/0043747 | A1 * | 3/2006 | Kniss | B25J 13/086 294/65 |
| 2006/0286769 | A1 * | 12/2006 | Tsuchiya | B65H 3/0816 438/458 |
| 2007/0187026 | A1 | 8/2007 | Burgess et al. | |
| 2007/0277919 | A1 | 12/2007 | Savol et al. | |
| 2011/0071666 | A1 * | 3/2011 | Martin | B65H 1/28 700/231 |
| 2011/0240213 | A1 | 10/2011 | Barlag et al. | |

FOREIGN PATENT DOCUMENTS

| | | | | |
|---|---|---|---|---|
| DE | 29502103 | U1 | 3/1995 | |
| DE | 102011106214 | A1 | 12/2012 | |
| EP | 0429901 | A1 | 6/1991 | |
| EP | 1526384 | A2 | 4/2005 | |
| JP | S6071436 | A | 4/1985 | |
| JP | 5-221540 | * | 8/1993 | B01J 29/7615 |
| JP | H0951195 | A | 2/1997 | |
| WO | WO 03035375 | A1 | 5/2003 | |
| WO | 2012167853 | A1 | 12/2012 | |
| WO | WO 2014094903 | A1 | 6/2014 | |

OTHER PUBLICATIONS

Chinese Office Action dated Nov. 16, 2017 for Chinese Patent Application No. 201480069827.6.
Chinese Office Action dated Mar. 30, 2017, for Chinese Patent Application No. 201480069827.6.

* cited by examiner

FABRIC POSITIONING APPARATUS

CROSS-REFERENCE TO RELATED APPLICATION(S)

This is a National Stage Entry into the U.S. Patent and Trademark Office from International PCT Patent Application No. GB /2014/053644, having an international filing date of Dec. 9, 2014, and which application claims priority to U.S. Patent Application Ser. No. 61/918,293, filed 19 Dec. 2013, the entire contents of both of which are incorporated herein by reference.

FIELD OF THE INVENTION

The present invention concerns the construction and operation of an apparatus designed to adjust the height and orientation of an associated fabric attractor, such as a fabric lifting suction cup. More specifically, the present invention concerns a device intended to assist with the lifting, manipulation, and transfer fabric from a transfer station to a mold. Even more specifically, the apparatus of the present invention is designed to assist with the lifting, manipulation, and transfer fabrics used to manufacture components made from composite materials, such as those employed for the construction of aircraft.

DESCRIPTION OF THE RELATED ART

The prior art includes examples of several devices that may be employed to handle fabric materials. This includes woven and non-woven fabric such as flexible carbon fabric.

By way of background, as should be apparent to those skilled in the art, for large, low volume composite components, hand lay-up remains the most common method for molding such composite components, which include items such as aircraft components, aircraft wings, aircraft fairings, boat hulls, wind turbines blades, and the like.

The assembly of certain aircraft components, such as aircraft wings, involves the formation of complex, three dimensional geometries with multiple curvatures. To create these geometries, large pieces of carbon fiber fabric are employed together with stiffeners (also called stringers in aircraft) that are integrated into the wing skin. For a conventional hand layup, it is estimated that about an hour is required to handle about 15 kg (38.1 lb) of fabric material. Production time is therefore an issue.

As should be apparent to those skilled in the art, manual processes are prone to error and may, in some instances, lack precise reproducibility.

It is known, for example, that manual handling of fabric materials may result in stretching or creasing of the fabric material. In addition, if gripping tools are used, the gripping tools may damage the fabric during handling, especially at the locations where the gripper tools are used. These deformations may adversely affect the ability to produce a composite component by increasing production times, especially if damaged fabric plies need to be removed and replaced prior to final formation of the composite component.

By way of background, some prior art references describe the formation of composite structures relying on plies of carbon fiber fabric. Other prior art references rely on tapes (i.e., narrow strips) of composite materials that are applied in an overlapping pattern. It is the first of these two techniques that presents particular challenges to the manufacturer of composite components.

U.S. Pat. No. 6,343,639 (hereinafter "the '639 Patent") describes a machine for laying up fabric to produce a laminate. The machine includes a table 18 with a perforated upper surface 19. (The '639 Patent at col. 2, lines 59-64.) Fabric is deposited onto the table 18 from a roll of fabric 30. (The '639 Patent at col. 3, lines 5-10.) A roller 48 is provided to pick up the fabric element, after being cut into the appropriate shape, using vacuum pressure. (The '639 Patent at col. 4, lines 28-37.) The shaped material is then transferred to a layup station 40, 42 where it is deposited. (The '639 Patent at col. 4, lines 38-46.)

U.S. Patent Application Publication No. 2007/0187026 (hereinafter "the '026 application") describes a fabric handling apparatus and a method of composite manufacture. Here, the fabric is cut and shaped on a cutting table 110. (The '026 application at paragraph [0023].) The cut fabric may then be transferred from the cutting table 110 to a mold table 170 after being rolled up onto a vacuum actuated take up drum 130. (The '026 application at paragraphs [0024]-[0025].)

U.S. Patent Application Publication No. 2011/0240213 (hereinafter "the '213 application") describes a method and device for laying and draping portions of reinforcing fiber structure to produce a profiled preform. The '213 application relies on opposed roller conveyors 21, 22 to deposit fabric onto a core 19. (The '213 application at paragraph [0053].)

U.S. Pat. No. 8,088,236 (hereinafter "the '236 Patent") describes an apparatus and method for producing a large area fiber composite structural component. The apparatus includes a shaping element 1 onto which a nonwoven carpet 15 is deposited from nonwoven rolls 2, 3. (The '236 Patent at col. 6, lines 4-13.)

U.S. Pat. No. 7,228,611 (hereinafter "the '611 Patent") describes a method of transferring a large uncured composite laminate from a male layup mandrel tool to a female cure tool. (The '611 Patent at the Abstract.)

U.S. Pat. No. 8,114,241 (hereinafter "the '241 Patent") describes a method for applying a vacuum bag around a fuselage barrel made of material to be polymerized. The sheet of bag material 30 is applied to the mandrel 10 as the mandrel rotates about a rotational axis. (The '241 Patent at col. 4, lines 1-6.)

U.S. Pat. No. 7,611,601 (hereinafter "the '601 Patent") describes an automated layup system and method that relies on the application of multiple strips of fabric onto a layup mold or tool. (The '601 Patent at col. 4, lines 40-64.)

U.S. Pat. No. 7,137,182 (hereinafter "the '182 Patent") describes an apparatus for forming a composite structure that relies on a plurality of material dispensers, arranged side-by-side, to deposit strips of material 62 onto a mold. (The '182 Patent at col. 4, lines 8-35.) The mold is positioned on a rotary turntable 80. (The '182 Patent at col. 3, lines 39-47.)

U.S. Patent Application Publication No. 2007/0277919 (hereinafter "the '919 application") describes a system and method for automatic monitoring of a composite manufacturing process. The process relies on laser light to assist with detection of edges, overlaps, gaps, wrinkles, and foreign object debris that may impact upon the manufacturing process. (The '919 application at the Abstract.)

While each of the methods and apparatuses described above provide at least some solutions for automating the manufacture of fabric components, a desire remains for mechanical devices that automate the layup and handling of large plies of fabric materials.

Additionally, there is a desire for a mechanical device that may help to improve the reliability, accuracy, and repeatability of layup processes associated with the manufacture of components, such as aircraft components, from composite fabric materials.

In summary, there remains a need for a device that handles fabric materials, such as fabrics used in the manufacture of composite components, without crimping, folding, stretching, or otherwise changing the shape of the fabric material as it is being handled.

SUMMARY OF THE INVENTION

The present invention addresses one or more deficiencies associated with the prior art.

In particular, the present invention provides for an apparatus that facilitates the handling and transfer of a flexible material, such as a fabric from one location to another.

More specifically, the present invention provides for the handling and transfer of fabric from one location to another via an array of fabric handlers that are connected to an array plate. It is contemplated that the handlers are connected passively to the array plate such that movement of the array plate results in movement of individual ones of the handlers.

A first aspect of the present invention provides a positional adjustment apparatus for an attractor, comprising: a positioning plate disposable at least adjacent to a surface of a mold, at least one drive operatively connected to the positioning plate to move the positioning plate and alter at least one of a first height, a first angle of tilt, a first lateral position, and a rotational position of the positioning plate with respect to the surface of the mold; at least one positioner disposed in an opening through the positing plate, the positioner hanging from and being moveable independently of the positioning plate; at least one attractor connected to the at least one positioner, and a joint disposed between the positioner and the positioning plate, the joint permitting the at least one positioner to change at least one of a second height, a second angle of tilt, and a second lateral position with respect to the positioning plate.

It is contemplated that the positioning plate may be a planar sheet defining a plurality of openings therein. Alternatively, the positioning plate may be a truss having a plurality of openings therein.

It is contemplated that the at least one drive connects to the positioning plate.

It is also contemplated that the at least one positioner includes a plurality of positioners and the at least one attractor includes a plurality of attractors, each positioner includes a cap at a top end, preventing each positioner from falling through each opening in the positioning plate, and each positioner includes one of the plurality of attractors attached at a bottom end.

In one embodiment, it is contemplated that the attractors may be suction cups. Alternatively, the attractors may be a electrostatic element.

In other embodiments, each positioner may include a rod made from a material including, but not limited to, steel, metals, metal alloys, plastic, thermoplastic materials, composite materials, nylon, polytetrafluoroethylene, aramid composites, ceramics, and cellulosic materials.

In selected embodiments of the present invention, each joint may include a sleeve disposed within each opening in the positioning plate, and a rotary pivot captively disposed within each sleeve, wherein each positioner may be slidably disposed through a hole in each rotary pivot, permitting adjustment of the second height of each positioner with respect to the positioning plate, and wherein each rotary pivot is rotatable within each sleeve, permitting adjustment of the second angle of each positioner with respect to the positioning plate. While not limiting of the present invention, it is contemplated that each rotary pivot is spherical.

Alternatively, it is contemplated that each joint may include a rotary pivot non-captively disposed above each opening in the positioning plate, wherein each positioner is slidably disposed through a hole in each rotary pivot, permitting adjustment of the second height of each positioner with respect to the positioning plate, and wherein each rotary pivot is rotatable, permitting adjustment of at least one of the second angle of each positioner with respect to the positioning plate and a distance of each positioner from edges of each opening. As before, it is contemplated that each rotary pivot is spherical.

In still another contemplated embodiment, each joint may include a sleeve disposed within each opening in the positioning plate, a first rotary pivot captively disposed within each sleeve; and a second rotary pivot non-captively disposed above each opening in the positioning plate, wherein each positioner is slidably disposed through a first hole in each first rotary pivot and each positioner is slidably disposed through a second hole in each second rotary pivot, permitting adjustment of the second height of each positioner with respect to the positioning plate, and wherein each first rotary pivot is rotatable within each sleeve, permitting adjustment of the second angle of the positioner with respect to the positioning plate. The first and second rotary pivots may be spherical.

In addition, it is contemplated that at least one positioner includes a plurality of positioners and the at least one attractor includes a plurality of attractors, wherein the apparatus is contemplated also to include a connector connecting adjacent attractors to one another. The connector may be a plurality of rods connected to one another, end to end, via joints. Alternatively, the connector may be a flexible rod. In a further contemplated embodiment, the connector may be a flexible sheet.

Still further features of the present invention should be appreciated from the drawings appended hereto and from the discussion herein.

BRIEF DESCRIPTION OF THE DRAWINGS

The present invention will now be described in connection with the drawings appended hereto, in which.

DETAILED DESCRIPTION OF EMBODIMENT(S) OF THE INVENTION

Figure 1:
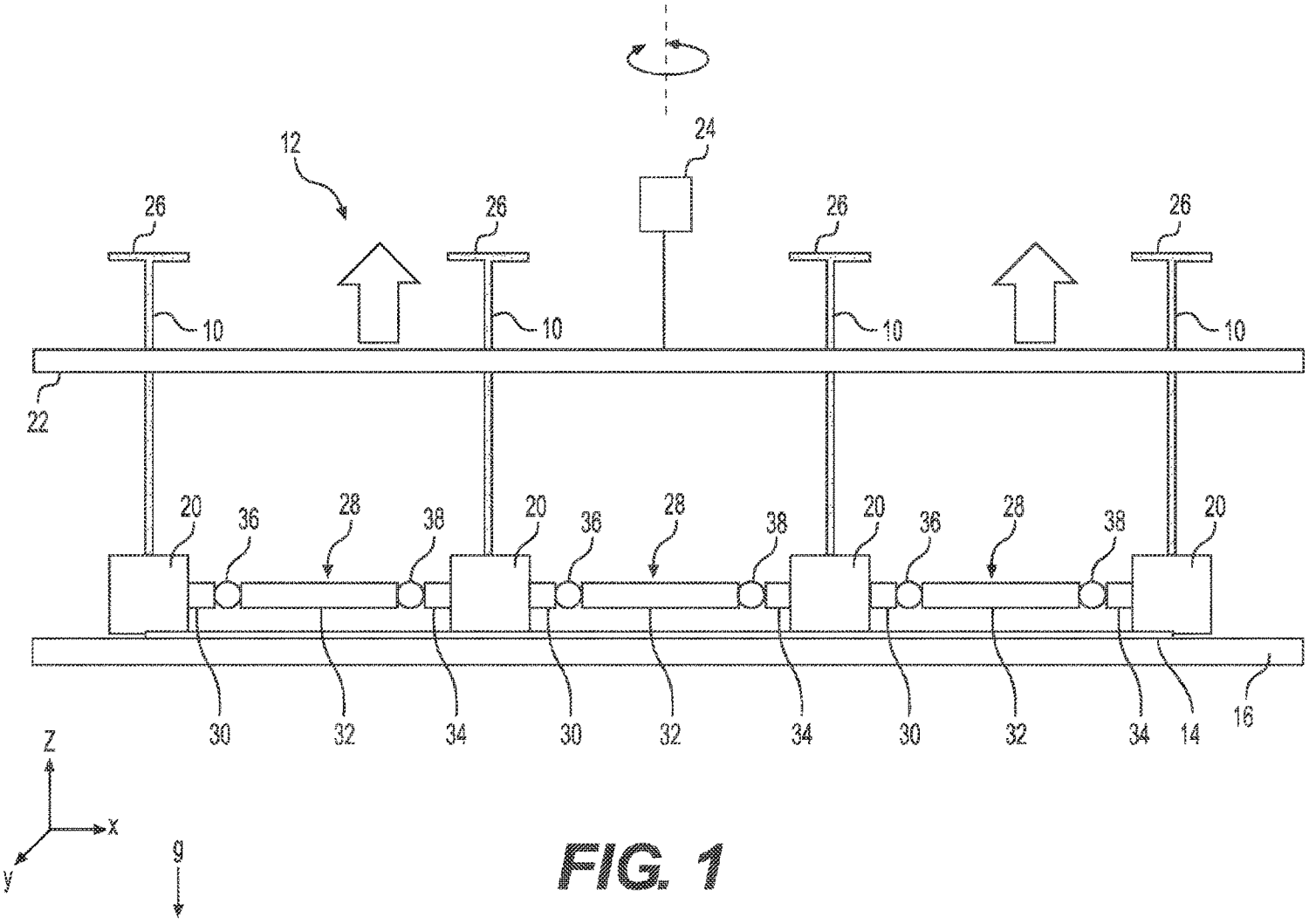
FIG. 1 is a graphical, side view of a first embodiment of a fabric handling array according to the present invention, showing the array just after gripping of the fabric by the attractors but prior to lifting the fabric from the pickup table.

The present invention will now be described in connection with one or more embodiments. Discussion of any one particular embodiment is intended to be illustrative of the breadth and scope of the invention. In other words, while attention is focused on specific embodiments, those embodiments are not intended to be limiting of the scope of the present invention. To the contrary, after appreciating the discussion and drawings presented herein, those skilled in the art will readily appreciate one or more variations and equivalents of the embodiments described and illustrated. Those variations and equivalents are intended to be encompassed by the present invention as though they were described herein.

The modern manufacture of aircraft has recently departed from traditional reliance upon aluminum and aluminum alloys for the external components of the aircraft and moved to a greater reliance on composite materials. It is anticipated that future aircraft will rely even more heavily on components made from composite materials. The reason for this is simple: as a general rule, composite materials are stronger and lighter than their metallic counterparts and, at least for this reason, present engineering and design advantages over metals and their alloys. In addition, fewer parts typically are required when composite parts are used in the construction of an aircraft, for reasons apparent to those skilled in the art.

Manufacture of components from composite materials, however, is not without its engineering challenges.

As should be apparent to those skilled in the art, and by way of background to the discussion that follows, the term "composite material" encompasses a broad category of different substances. In the context of aircraft manufacture, composite materials are understood to refer to fabrics made primarily from carbon fibers and resins. While the present invention is contemplated to encompass carbon fiber fabrics, the present invention is not intended to be limited thereto. Other fabrics used in the manufacture of composite components are also intended to be encompassed by the scope of the present invention. For example, the present invention includes, but is not limited to, materials incorporating aramid fibers, ceramics, glass, and related compounds, either now known or developed in the future. Moreover, fabrics that combine different compounds and materials together also are intended to be encompassed by the present invention.

As a general rule, fabrics fall into one of two categories. The first category is woven fabrics. Woven fabrics encompass those that are made from threads of composite materials. Woven fabrics have a weft and weave, as should be apparent to those skilled in the art. These materials are similar to cloth made from other fibrous materials, such as cotton. The second category is non-woven fabrics. Non-woven fabrics encompass those that are not made from threads woven together. Typically, non-woven fabrics combine a plurality of fibers that are randomly intertwined to form a batt or alternatively, aligned in a particular direction. These materials are sometimes known as having uni-directional or uni-axial fibers.

As should be apparent to those skilled in the art, when constructing an aircraft component, after multiple layers of fabric are layered onto one another in a predetermined orientation, a resin or other type of matrix material is used to bind the fabric layers to one another. Matrix materials include, but are not limited to, resins, epoxy materials, nylon, polyester, polypropylene, ceramics, and the like.

In the art, it is known that the fabric may be pre-impregnated with a matrix material, such as resin. Such fabrics are often referred to as "prepreg" fabrics. Alternatively, the fabric may be a "dry" fabric, meaning that the fabric is not pre-impregnated with the matrix material, such as resin.

In either case, it is generally recognized that the matrix material will be introduced into the fabric and cured, typically using pressure and/or heat to create the composite material component. Once cured into a hardened component, the hardened component may be further machined to fabricate the aircraft part.

One process employed for manufacturing and curing a composite fabric structure is known to those skilled in the art as "Resin Transfer Infusion" or "RTI." Other processes also are known in the art, and the present invention is not intended to be limited to RTI.

As also should be apparent to those skilled in the art, regardless of the type of fabric employed for the construction of an aircraft component (i.e., a prepreg or a dry fabric), construction techniques using those fabrics tend to fall within two general categories. A first approach to the manufacture of aircraft parts relies on the repetitive application of layers of fabric strips, including what is commonly referred to as "tape" or "tow." In this method of manufacture, the strips are applied to the surface of a mold, following a predetermined pattern. In a second approach to the manufacture of aircraft components, sheets of fabric, cut into predetermined shapes, are laid over one another in a predetermined pattern and arrangement. In either technique, the orientations of the fibers in the layers typically are altered from layer to layer. With each layer having a slightly different orientation, the strength of the aircraft component may be maximized in any specific direction.

With respect to the manufacturing method that relies on the use of fabric strips, the strips are usually dispensed from a roll. In particular, as the roll of strips passes over the surface of the mold, a single layer of the fabric strips are dispensed onto the mold in parallel lines. The orientation of the roll may be altered for each successive application of the strips to vary the directional orientation of the composite fibers.

The second manufacturing method relies primarily on human manipulation of the fabric. Specifically, individual pieces of material are first shaped by means of a cutting machine or other method and then positioned on the mold in the correct orientation. It is, of course, possible to employ one or more mechanical devices to position pieces of pre-cut fabric in a suitable orientation for formation of the aircraft component. It is with this second manufacturing method, in particular an automated process therefor (or at least partially automated), that the present invention concerns itself.

When mechanical devices pickup and carry a piece of fabric to lay the fabric on a mold in a predetermined orientation, it is preferred for the fabric to be deposited on the mold so that the fabric is positioned properly and so that the fabric is not deformed, folded, or otherwise distorted. As should be apparent, when the fabric is deposited so that the fabric is in the correct orientation and without distortions, the layers of fabric will properly form the final composite structure after introduction and/or hardening of the matrix material.

As should be apparent from the discussion of the related art, many automated devices rely on vacuum rolls to pick up and transfer composite fabric from one location to another.

Figure 3:
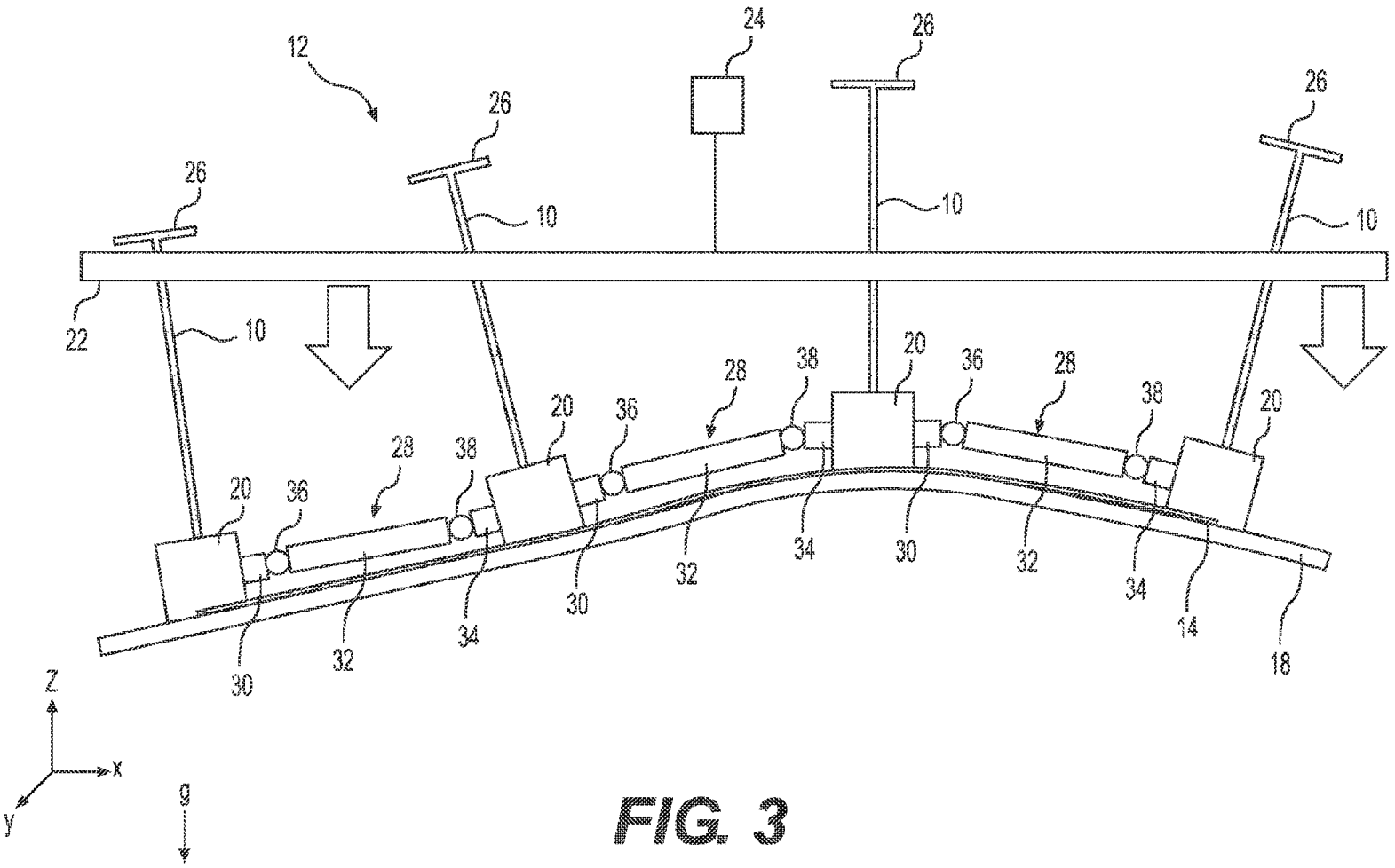
FIG. 3 is a graphical, side view of the fabric handling array illustrated in FIG. 1, showing the fabric handling array at a point prior to placement of the fabric onto the mold, after the fabric handling array has conformed to the surface contours of the mold.

The present invention provides a positioner 10 that is intended to cooperate with a fabric handling array 12 for the pickup of composite fabrics 14 from a first location 16 (such as a layup table 16, where cutting may or may not occur), with the purpose of transferring the fabric 14 to a second location 18 (such as a mold 18, shown in FIG. 3). Before describing the details of the positioner 10, a discussion of the fabric handling array 12 is provided.

Figure 18:
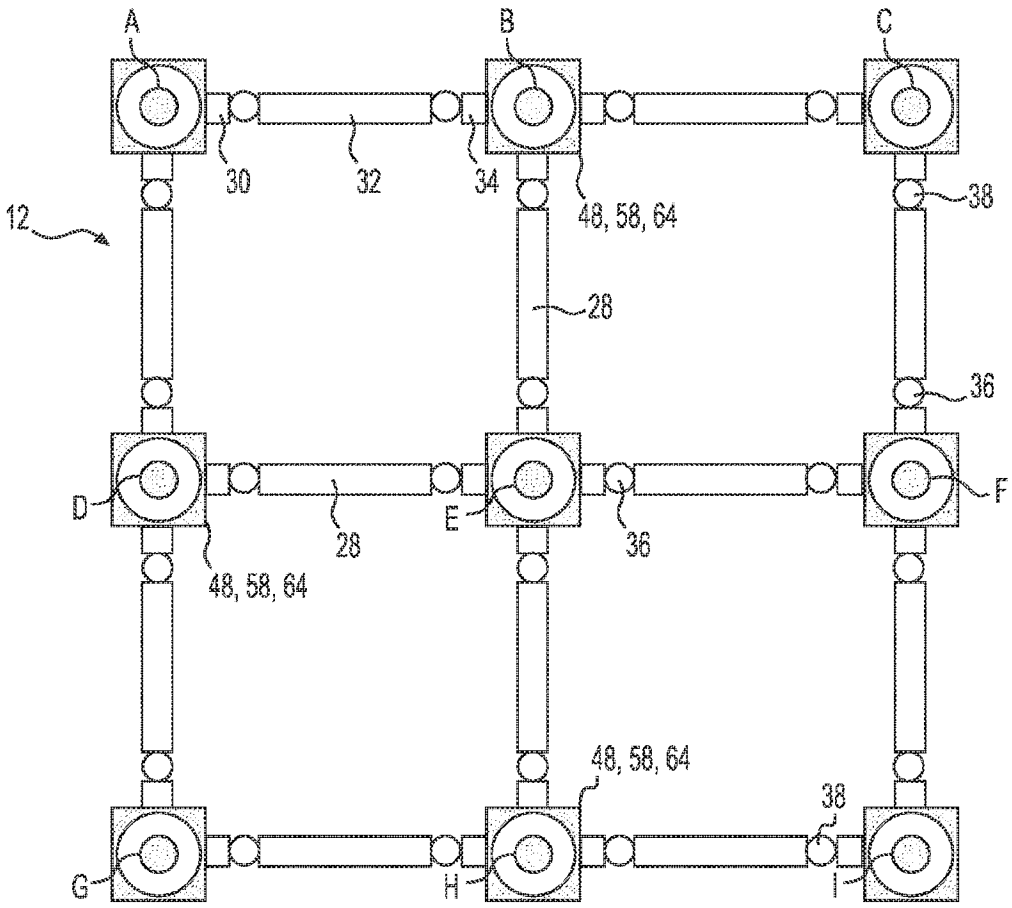
FIG. 18 is a graphical, top view of a portion of the fabric handling array illustrated in FIG. 1.

The fabric handling array 12 includes a plurality of fabric attractors 20 that are arranged in a grid pattern as illustrated in FIG. 18 (showing a graphical top view of the array 12). The attractors 20 are arranged along an x-y plane. As will be made apparent in the discussion that follows, the positions of the attractors 20 are moveable with respect to one another, so that the composite fabric 14 may be deposited in a predetermined location and orientation at the second location 18 (i.e., onto the mold).

The attractors 20 are contemplated to be suction cups or any other form of gripping media that are attached to the positioners 10. In one contemplated embodiment, the attractors 20 are contemplated to be suction cups. However, the attractors 20 may be electrostatic devices or any other suitable equivalent. Mechanically operated attractors 20 also may be employed to handle the composite fabric 14. Regardless of the type of attractor 20 employed, the attractors 20 are contemplated to grip onto the composite fabric 14 without damaging or otherwise distorting the composite fabric 14.

The positioners 10 are connected to a positioning plate 22 that, in the illustrated embodiment, is a planar structure disposed above the array of attractors 20. Gravity g acts upon the attractors 20, which helps the attractors 20 to hang from the positioning plate 22 via their respective positioners 10. Specifically, the positioners 10 extend through the plate 22 such that the positioners are moveable with respect thereto. To prevent the positioners 10 from passing entirely through the plate 22, the positioners 10 are provided with caps 26 that retain the positioners on the plate 22 regardless of the position of the plate 22 with respect to the layup table 16, the mold 18, or other structure. As should be apparent, when the plate 22 has moved to a position where the caps 26 lie on the top surface of the plate 22, the positioners 10 and attractors 20 are lifted and move together with the plate 22.

While the positioning plate 22 is illustrated as a planar structure, it is noted that the positioning plate 22 may be constructed as a structural matrix, such as a truss. The exact construction of the positioning plate 22 is not critical to the present invention. In one alternative construction, the positioning plate 22 may not be planar in shape. Instead, the positioning plate 22 may be designed with a predetermined curvature or other three-dimensional configuration.

It is noted that the various embodiments of the array 12 and the positioning plate 22 are described herein as having square or rectangular shapes. These shapes, however, are not required to practice the present invention. To the contrary, the array 12 and the positioning plate 22 may take any suitable shape without departing from the scope of the present invention. For example, the array 12 and positioning plate 22 may be triangular, hexagonal, polygonal, circular, semi-circular, elliptical, or amorphously-shaped.

The positioners 10 are contemplated to be rigid rods that are freely moveable along the z axis and in angular orientation with respect to the positioning plate 22. The z-axis is parallel to (or at least substantially parallel to) the force of gravity g. While contemplated to be rigid rods, it is noted that the positioners 10 may have any suitable shape and configuration without departing from the scope of the present invention.

As rigid rods, the positioners 10 are contemplated to be made from a rigid material, such as metal. To reduce the weight of the positioners 10, and, therefore the weight of the array 12, the positioners 10 may be made from a suitable metal such as aluminum or an alloy thereof. Alternatively, the positioners 10 may be made from any other suitable material including, but not limited to steel, metals, metal alloys, plastic, thermoplastic materials, composite materials, nylon, polytetrafluoroethylene, aramid composites, ceramics, cellulosic materials, and the like. As should be apparent, the exact material used for the construction of the positioners 10 is not critical to the construction of the present invention. It is noted, however, that materials employed for the positioners 10 are likely to resist bending, stretching, and/or compression forces during operation so that the attractors 20 maintain suitable positions with respect to one another.

While the positioners 10 are illustrated as rigid rods (and are contemplated to be rigid rods), it is noted that the positioners 10 may have some modest degree of flexibility. In other words, the term "rigid" as applied to the positioners is not intended to mean that the positioners 10 are completely inflexible. As will be apparent from the discussion that follows, some flexibility in the positioners 10 may assist with the positioning of the fabric 14 at the second location 18 (e.g., at the mold 18) by providing a small tolerance with respect to movement, as required or as desired.

The positioning plate 22 is contemplated to be connected to a positioner drive 24. The drive 24 connects to the positioning plate 22 so that the positioning plate may be adjusted in the height direction (e.g., parallel to the direction of gravity g). As discussed in greater detail below, the positioners 10 are freely movable in relation to the positioning plate 22 in the manner noted above. With control over the height of the positioning plate 22, therefore, it becomes possible to orient the fabric 14 in virtually any orientation with respect to the mold 18 when depositing the fabric 14 onto the mold 18.

The drive 24 may have any construction and operation that is suitable for the array 12. It is contemplated, in one embodiment, that the drive 24 may have a geared attachment to the positioning plate 22. In another contemplated embodiment, the drive 24 may be connected to the positioning plate electromagnetically. Still further, the drive 24 may be connected to the positioning plate 22 via a cable or other flexible connector. As should be apparent to those skilled in the art, the drive 24 may be connected to the positioning plate 22 via any of a number of different connections without departing from the scope of the present invention.

It is noted that the drive 24 may include multiple drive units that cooperate with one another to adjust the height of the positioning plate 22. In other words, the present invention is not intended to be limited to a construction where a single drive 24 is associated with the positioning plate 22.

During operation of the array 12, the positioning plate 22 is contemplated to remain parallel to the ground (i.e., perpendicular to the force of gravity g). However, this is not required for operation of the present invention. It is contemplated that the positioning plate 22 may be tilted with respect to a horizontal position, as required or as desired. In addition, the positioning plate 22 may be rotated around an axis, such as a central axis, if required or desired.

The positioners 10 are each topped with a cap 26. The cap 26 assures that the positioners 10 hang from the plate 22, among other benefits that should be apparent to those skilled in the art. It is noted that the positioners 10 are all shown to have the same length. It is contemplated, however, that the positioners 10 may have different lengths. In addition, it is contemplated that the location of the cap 26 may be adjustable on the positioner 10 to alter the location of the associated attractor 20.

The attractors 20 are connected to one another via connectors 28. The connectors 28 extend between adjacent attractors 20 to maintain the attractors 20 in a positional relationship with one another.

In the illustrated embodiment, the connectors 28 each are constructed from three rods 30, 32, 34 that are connected to one another via joints 36, 38. The connectors 28 maintain the attractors 20 in positional relation to one another, but permit attractors 20 to move as a group. As should be apparent from FIG. 14, the attractors 20 are limited in their lateral movement with respect to one another. The connectors 28 ensure that the attractors 20 move as a group and that the distance between any two individual attractor 20 is not permitted to vary in any significant way. If one attractor 20 were to move to a position significantly different from an adjacent attractor 20, the fabric 14 might become distorted, thereby rendering the fabric 14 unsuitable for the manufacture of a multi-ply fabric composite component.

Figure 2:
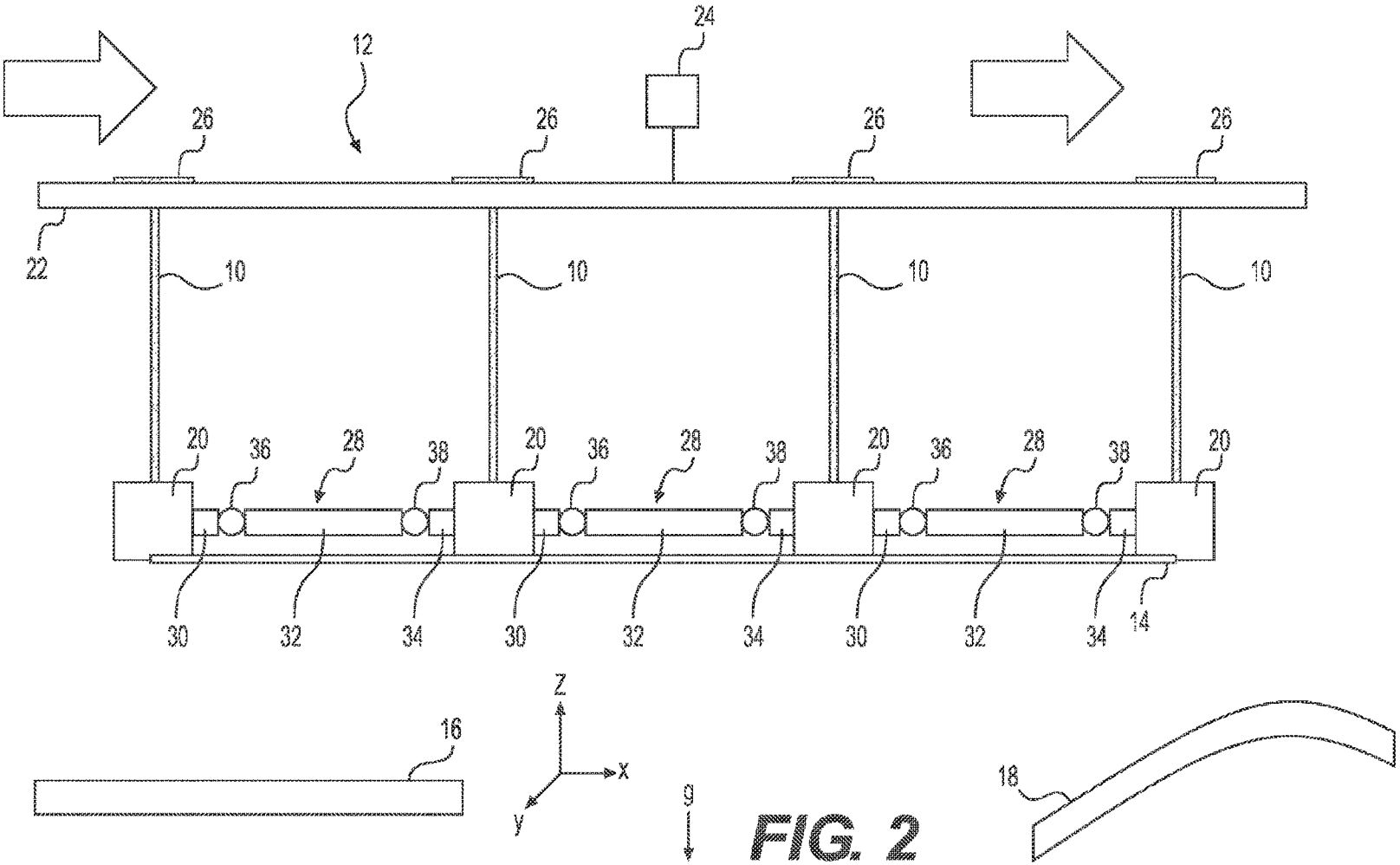
FIG. 2 is a graphical, side view of the fabric handling array illustrated in FIG. 1, showing the array at a midpoint between the pickup table and the mold, both of which are illustrated in graphical format in this drawing.

FIG. 2 is a graphical side view of the array 12 after picking up the fabric 14 but before depositing the fabric 14 onto the mold 18. Since the attractors 20 are permitted to move independently with respect to the positioning plate, the attractors 20 are contemplated to fall to their respective, lowest-most positions under the force of gravity g, as illustrated.

FIG. 3 is a graphical side view of the array 12 at the point where the array 12 is positioned adjacent to the mold 18 and is prepared to deposit the fabric 14 onto the mold 18. Since the positioners 10 are connected movably to the positioning plate 22, the attractors 20 adjust their respective positions when lowered against the surface of the mold 18. Once the fabric 14 is deposited in the predetermined position and orientation, the attractors 20 release the fabric 14 so that the array 12 may return to the layup table 16 to acquire the next piece of fabric 14 for placement onto the mold 18. This process is repeated until all of the pieces of fabric 14 have been deposited onto the mold 18 in their predetermined positions and orientations.

It is noted that array 12 also may transport other materials to the mold 18. For example, one layer of the composite may include an adhesive layer or a honeycomb material. The array 12 may be provided with attractors 20 that are capable of transporting and orienting the materials as well.

In alternative arrangement of the array 12, it is contemplated that the connectors 28 may be replaced by flexible rods (not shown). In such a contemplated arrangement, the rods would not require any joints 36, 38. Instead, the rods would be provided with sufficient flexibility to permit adjacent attractors 20 to move with respect to one another, but with enough rigidity so that the distance between any two individual attractors 20 is not permitted to vary too much. As indicated above, the positioners 20 are contemplated to possess sufficient rigidity so that they resist stretching, compressing, and flexing, thereby maintaining the attractors 20 in a constant positional relationship with respect to one another.

Figure 4:
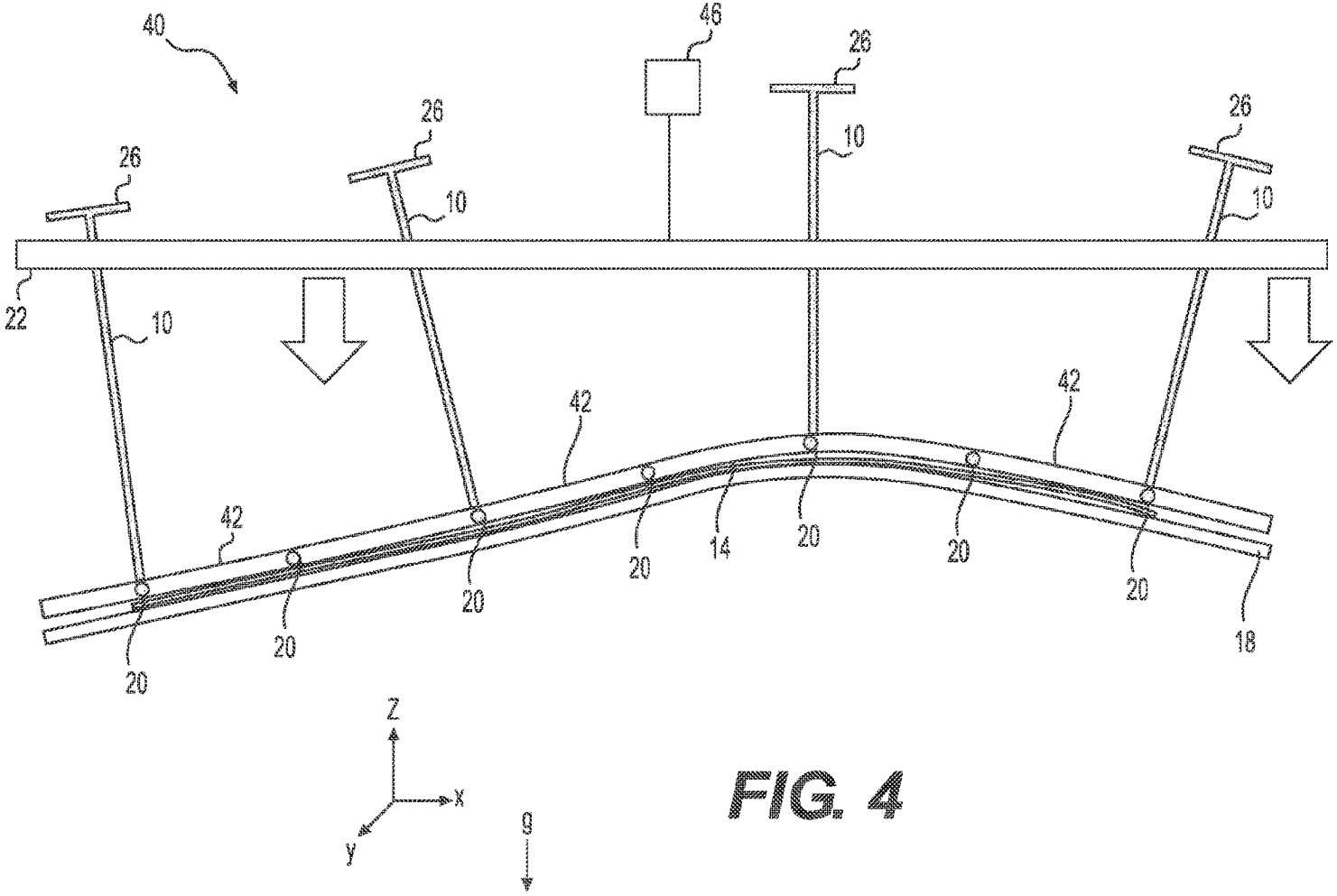
FIG. 4 is a graphical, side view of a second embodiment of a fabric handling array according to the present invention, this embodiment being a variant of the fabric handling apparatus shown in FIGS. 1-3, with the fabric handling array being shown in the same position as the first embodiment of the fabric handling array depicted in FIG. 3.

FIG. 4 illustrates a variation on the array 12. In this graphical, side view, a first variant of an array 40 is illustrated. The array 40 is similar to the array 12, except that the connectors 28 and the attractors 20 have been replaced with a single mat 42, which contains embedded electrostatic elements.

The mat 42 is contemplated to be sufficiently rigid that it cannot fold or otherwise introduce distortions in the fabric 14 carried by the array 40 from the pickup table 16 to the mold 18. In other words, the mat 42 is contemplated to be sufficiently rigid so that it presents a smooth, continuous surface to the fabric 14 before pickup of the fabric 14. In addition, the mat 42 is contemplated to be sufficiently rigid that it resists the formation of folds or other defects during transit from the pickup table 16 to the mold 18.

In the context of this second embodiment of the array 40 of the present invention, one or more electrostatic elements (otherwise referred to as electrostatic attractors) are associated with or incorporated into the mat 42. Although they are incorporated into or attached to the mat 42, these electrostatic elements are contemplated to be similar to (or the same as) the electrostatic attractors 20 described above. As a result, the electrostatic elements also are identified with reference numeral 20.

As should be apparent to those skilled in the art, the illustration of the electrostatic attractors 20 in FIG. 4 is intended to be merely illustrative of the different ways in which the electrostatic attractors 20 may be incorporated into the mat 42 or attached to the mat 42. The depiction of the placement of the electrostatic attractors 20 in the mat 42 shown in FIG. 4 is not intended to be limiting of the present invention.

As should be apparent to those skilled in the art, the incorporation of electrostatic attractors 20 in the mat 42 may be accomplished in a number of ways.

Figure 5:
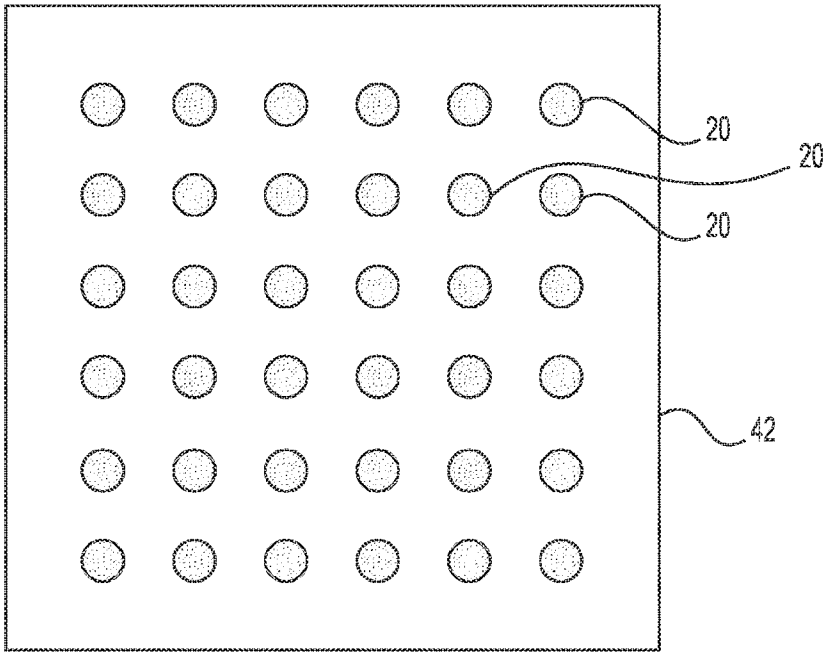
FIG. 5 is a graphical top view of a first variant of the electrostatic mat employed in the second embodiment of the fabric handling array illustrated in FIG. 4.

In the first variant, which is illustrated in FIGS. 4 and 5, the electrostatic attractors 20 are incorporated into the mat 42 as discrete elements. Here, the electrostatic elements 20 are shown as being circular. However, the electrostatic elements 20 need not be circular. Any shape may be employed without departing from the scope of the present invention.

Figure 6:
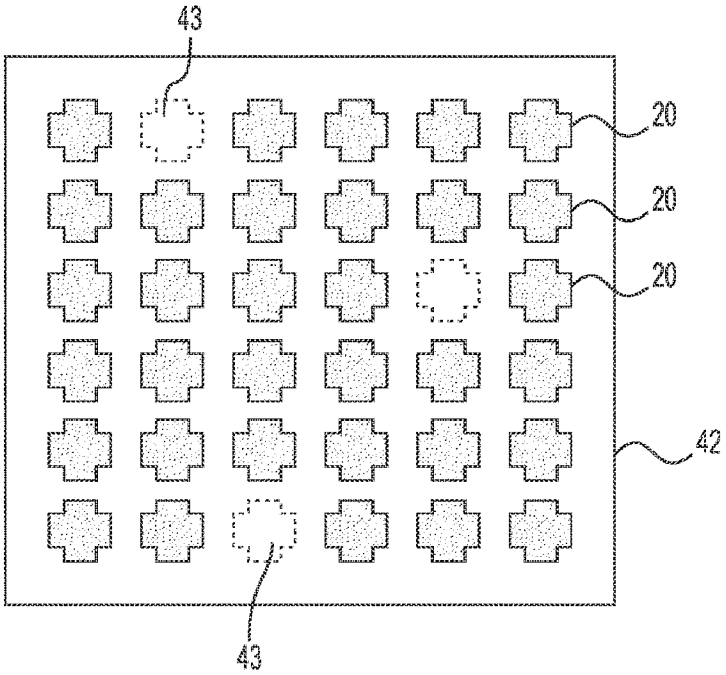
FIG. 6 is a second variant of the electrostatic mat illustrated in FIG. 5.

FIG. 6 illustrates a second contemplated variant of the electrostatic elements 20 in the mat 42. In this contemplated embodiment, the electrostatic elements are cruciform in shape. As in the prior embodiment, the electrostatic elements 20 are arranged in a regular pattern within the mat 42. As should be apparent, however, the electrostatic elements 20 need not be evenly (or regularly) spaced within the mat 42 to remain within the scope of the present invention. It is contemplated that the electrostatic elements may be arranged in a non-regular pattern while remaining within the scope of the present invention. To illustrate the non-regular arrangement, selected ones of the electrostatic elements 43 have been removed from the embodiment illustrated in FIG. 6.

Figure 7:
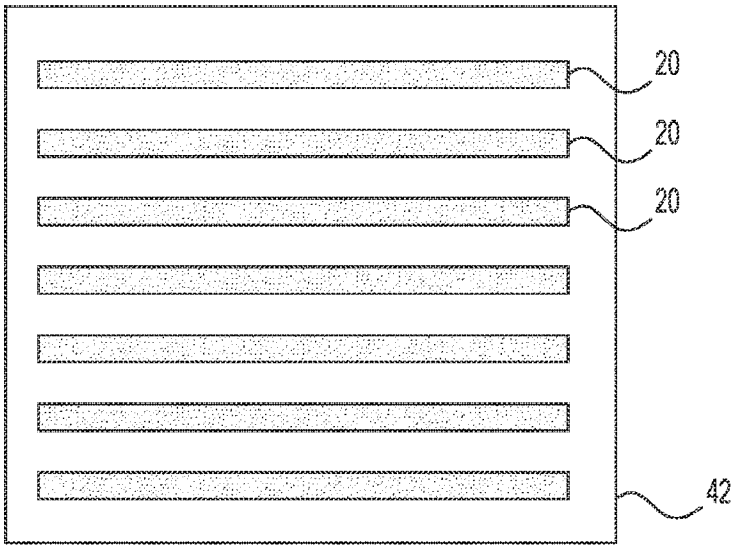
FIG. 7 is a third variant of the electrostatic mat illustrated in FIG. 5.

FIG. 7 illustrates a third contemplated variant of the mat 42 of the present invention. Here, the electrostatic elements 20 are shaped as bars that extend across the width of the mat 42. As should be apparent, the length and orientation of the electrostatic elements 20 is not particularly critical to the operation of the mat 42. Other lengths and orientations for the electrostatic elements 20 may be employed without departing from the scope of the present invention.

Figure 8:
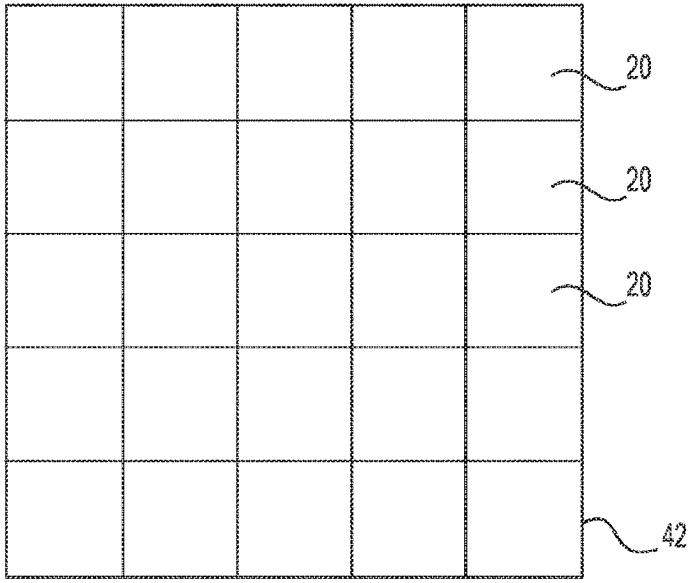
FIG. 8 is a fourth variant of the electrostatic mat illustrated in FIG. 5.

FIG. 8 illustrates a fourth contemplated variant of the mat 42 of the present invention. Here, the electrostatic elements 20 are defined as individual zones in or on the mat 42. Like the pixels on a video monitor, it is contemplated that the electrostatic elements 20 may be turned "on" or "off" as required or as desired. As should be apparent, the size and shape of the individual zones defining the electrostatic elements 20 may be varied without departing from the scope of the present invention.

It is noted that the intensity of attraction of the attractors 20 is contemplated to be adjustable. As such, it is contemplated that the array 12, 40 may lift and transport pieces of fabric 14 of differing weights, thicknesses, densities, etc.

In the illustrated examples, the mat 42 is a sheet of material to which the positioners 10 are attached. In other words, the mat 42 defines the connectors 42 between adjacent positioners 10.

As noted above, by using a sheet of material as the connectors 42, the attractors 20 are maintained in a suitable positional relationship with respect to one another, so that the fabric 14 is properly oriented when the array 40 reaches the mold 18. As should be apparent from the foregoing, the fabric 14 is picked up by the array 40 in a flat condition. The array 40 then transports the fabric 14 from the lay-up table 16 to the mold 18 in a flat condition (which is consistent with the shape of the positioning plate 22). It is only at the mold 18 where the electrostatic attractors 20 alter their positions with respect to the positioning plate 22, at the time that the fabric 14 is deposited onto the mold 18. It is contemplated that the mat 42 minimizes the introduction of imperfections into the fabric 14.

The material employed to construct the connectors (and/or connector sheet or mat) 42 may be any of a number of different substances. The connectors 42 may be made from woven fabric, non-woven fabric, cellulosic materials, composite materials, metals, alloys of metals, plastics, thermoplastics, rubber, rubber-like materials, nylon, polytetrafluoroethylene, polyethylene, ceramics, or the like. The exact composition of the connectors 42 is not critical to the operation of the present invention, except that the material should allow for sufficient flexure for the attractors 20 to be positioned appropriately for placement of the fabric 14 onto the mold 18.

Figure 9:
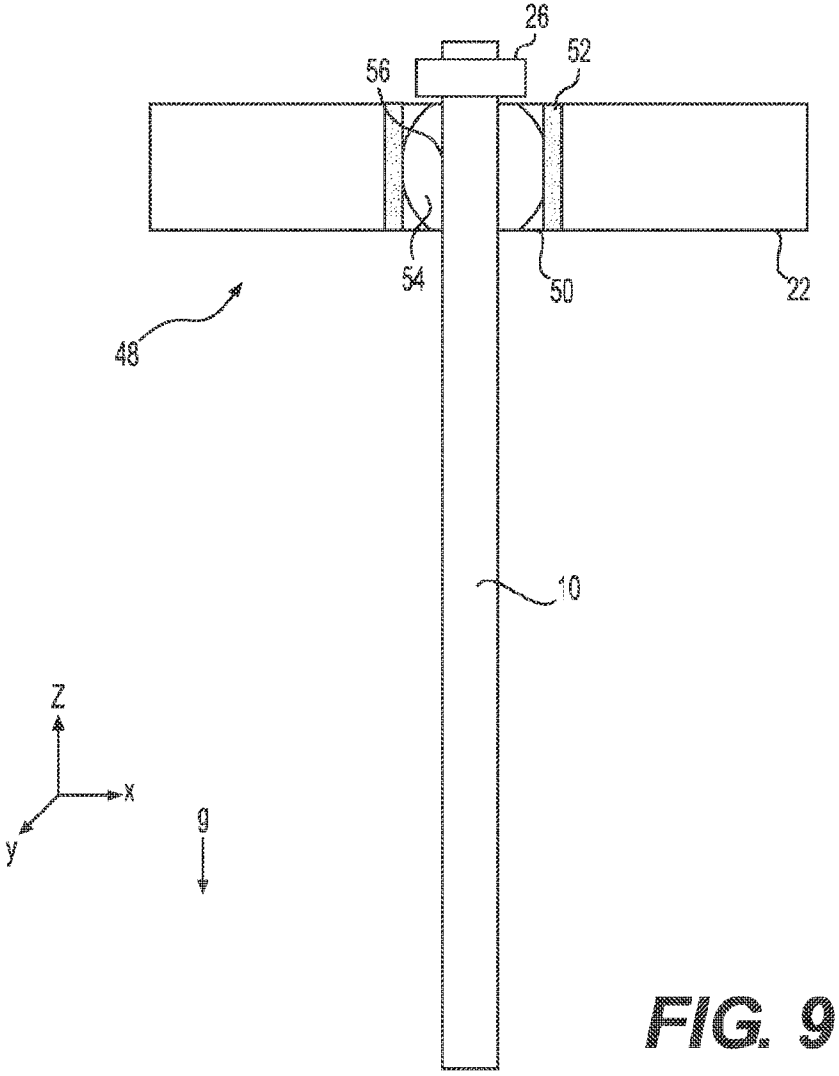
FIG. 9 is a graphical, side view of a first embodiment of a positioner connected to one of the fabric attractors forming the fabric handling array illustrated in FIG. 1, showing the positioner in a first orientation.

FIG. 9 illustrates a first embodiment of a rotary joint 48 (hereinafter also referred to generally as a joint) that is contemplated to connect one or more of the positioners 10 to the positioning plate 22. As illustrated, the positioning plate 22 includes a plurality of openings or holes 50. A positioner 10 is contemplated to be disposed in each of the openings 50. A sleeve 52 is disposed within the opening 50. The sleeve 52 engages a captive rotary pivot 54 within the opening 50. Although held in the opening 50 by the sleeve 52, the captive rotary pivot 54 is freely rotatable within the sleeve 52. The positioner 10 slidably engages the captive rotary pivot 54 via a hole 56 extending therethrough. As illustrated in this contemplated embodiment, the captive rotary pivot 54 is fashioned in the shape of a sphere or ball to facilitate movement of the positioner 10 within the opening 50.

While the particular materials selected for the construction of the positioner 10, the sleeve 52, or the captive rotary pivot 54 is not particularly critical to the operation of the present invention, it is contemplated that materials will be selected to move easily with respect to one another. In other words, it is contemplated that the materials selected for each of the components will resist binding with one another, thereby permitting free movement of the positioner 10 with respect to the positioning plate 22.

For example, the positioner 10 may be made from aluminum or an alloy thereof, as noted above. The captive rotary pivot 54 may be made from a compatible material that facilitates siding engagement with the positioner 10. The captive rotary pivot 54 also is contemplated to be made from a material that facilitates movement within the sleeve 52 in the opening 50.

Materials that may be selected for the captive rotary pivot 54 include, but are not limited to bronze, oil impregnated bronze, brass, oil impregnated brass, plastic, thermoplastic materials, ceramics, cellulosic materials, organic materials, polytetrafluoroethylene, or the like. As a result, the positioner 10 may slide easily within the hole 56 defined within the within the captive rotary pivot 54 without binding.

Similarly, the sleeve 52 is contemplated to be made from a material that permits rotation of the captive rotary pivot 54 therein. The sleeve 52, therefore, may be made from any material compatible with the material selected for the captive rotary pivot 54. A lubricant may be provided between the sleeve 52 and the captive rotary pivot 54 to facilitate rotation of the captive rotary pivot 54 within the sleeve 52.

Figure 10:
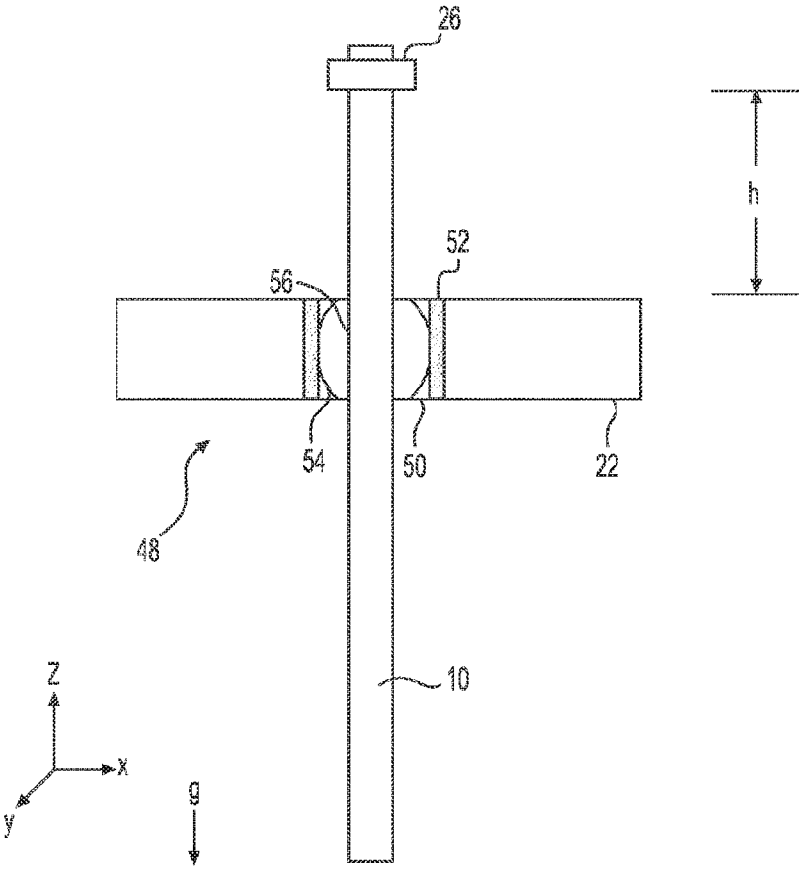
FIG. 10 is a graphical, side view of the positioner illustrated in FIG. 9, showing the positioner in second orientation.

FIG. 10 is a graphical side view of the rotary joint 48 shown in FIG. 9. In this view, the positioner 10 is shown after having slid within the hole 56 in the captive rotary pivot 54 to a different height h with respect to the positioning plate 22, as a result, for example, of positioning plate 22 having been lowered past the point where the extremity of the positioner 10 and/or the attractor 20 has made contact with layup table 16 or mold 18. As should be apparent from the foregoing, the height h is dictated by several variables including, but not limited to, the shape of the mold 18, the lengths of the positioners 10, and the distance of the plate 22 from the mold 18.

Figure 11:
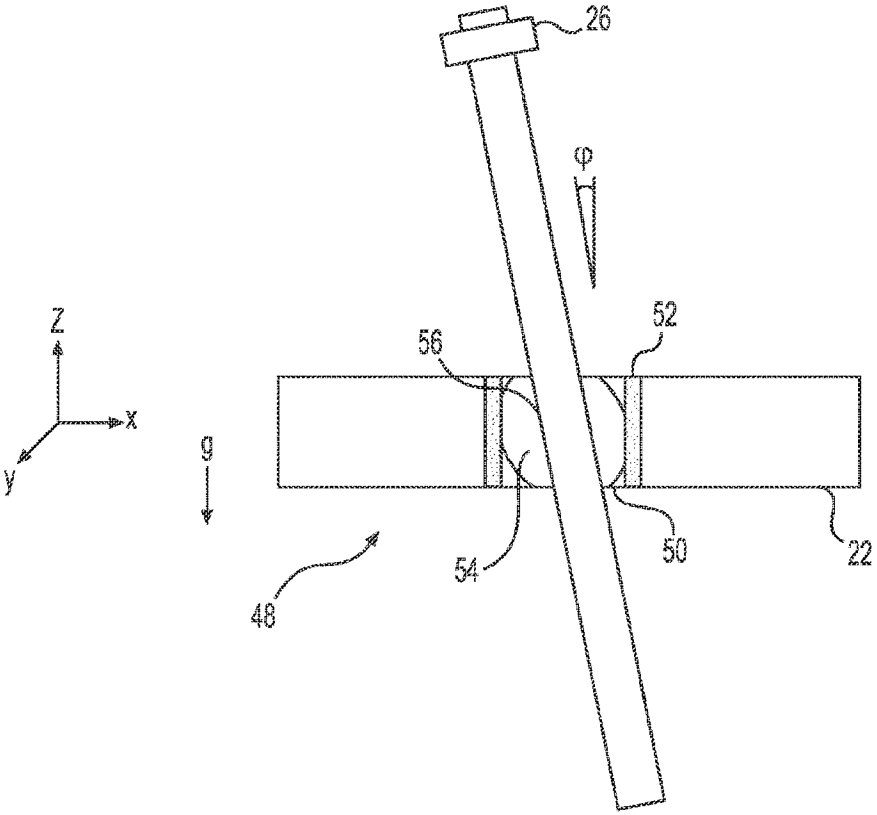
FIG. 11 is a graphical, side view of the positioner illustrated in FIG. 9, showing the positioner in a third orientation.

FIG. 11 is a graphical side view of the rotary joint 48 shown in FIG. 9. In this view, the captive rotary pivot 54 has rotated with respect to the position illustrated in FIG. 9. As a result, the positioner 10 has assumed a different angle φ with respect to the positioning plate 22.

Figure 12:
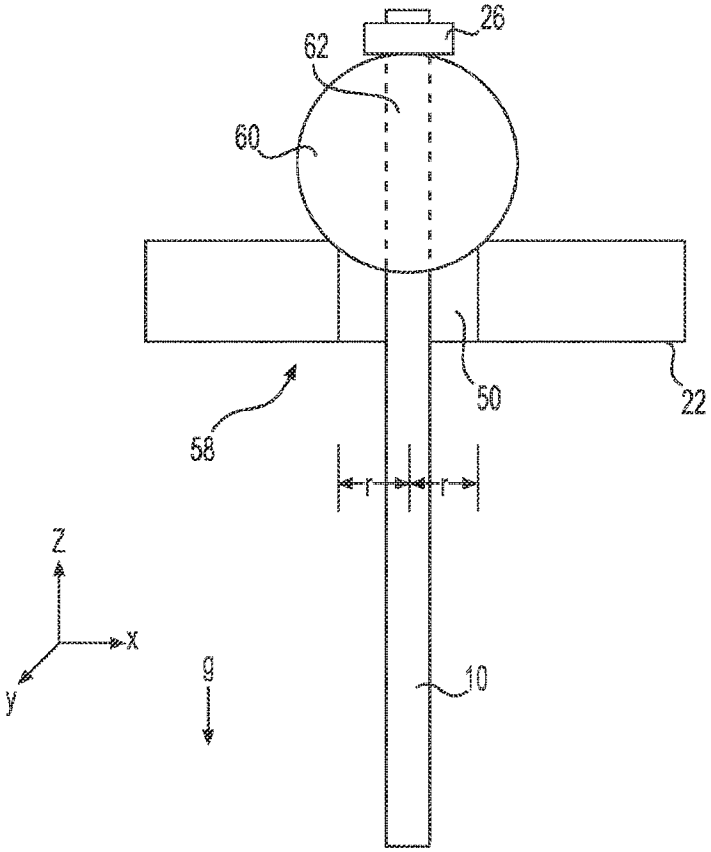
FIG. 12 is a graphical, side view of a second embodiment of a positioner connected to one of the fabric attractors forming the fabric handling array illustrated in FIG. 1, showing the positioner in a first orientation.

FIG. 12 illustrates a second embodiment of a rotary joint 58 (hereinafter also referred to generally as a joint) according to the present invention.

In this embodiment, the rotary joint 58 includes a non-captive rotary pivot 60 instead of the captive rotary pivot 54 illustrated with respect to the first embodiment. The non-captive rotary pivot 60 includes a central hole 62 through which the positioner 10 extends. In this embodiment, the non-captive rotary pivot 60 sits atop the positioning plate 22 and is not held captive within the opening 50.

As in the previous embodiment, the positioner 10 is freely slidable within the hole 62 in the non-captive rotary pivot 60. As such, as illustrated in FIG. 13, the positioner 10 may move such that the cap 26 is disposed a predetermined height h above the positioning plate 22.

Figure 14:
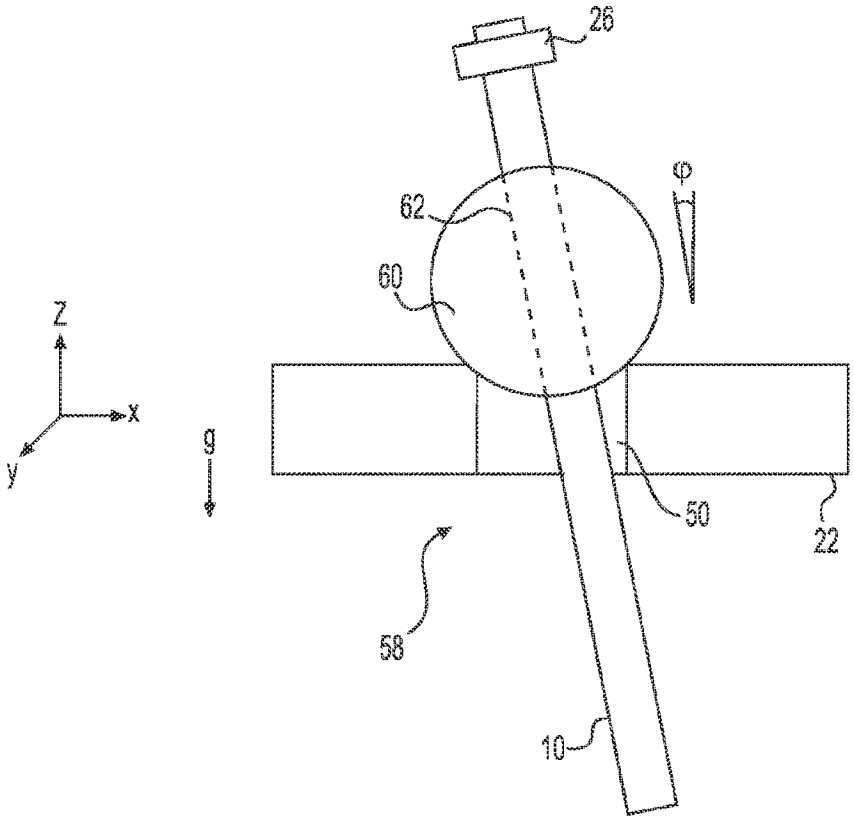
FIG. 14 is a graphical, side view of the positioner illustrated in FIG. 12, showing the positioner in a third orientation.

FIG. 14 illustrates the positioner 10 after having been angularly displaced with respect to the positioning plate 22 by angle cp. Again, this is similar to the operation of the rotary joint 48 but, in this instance, non-captive rotary pivot 60 is allowed to move with respect to the hole 50 when the extremity of positioner 10 (and/or the attractor 20) is in contact with an area of extreme curvature, such as at the mold 18, for example.

So that the non-captive rotary pivot 60 remains in contact with the positioning plate, it is contemplated that the non-captive rotary pivot 60 may be made from a material with a suitable weight. Contemplated materials include steel, but this is not intended to be limiting of the present invention. As noted above with respect to the captive rotary pivot 54, any of a wide variety of materials may be selected for the non-captive rotary pivot 60 without departing from the scope of the present invention. For example, the hole 50 may be recesses in the form of a countersink or other contoured form to allow improved location of pivot 60.

Figure 13:
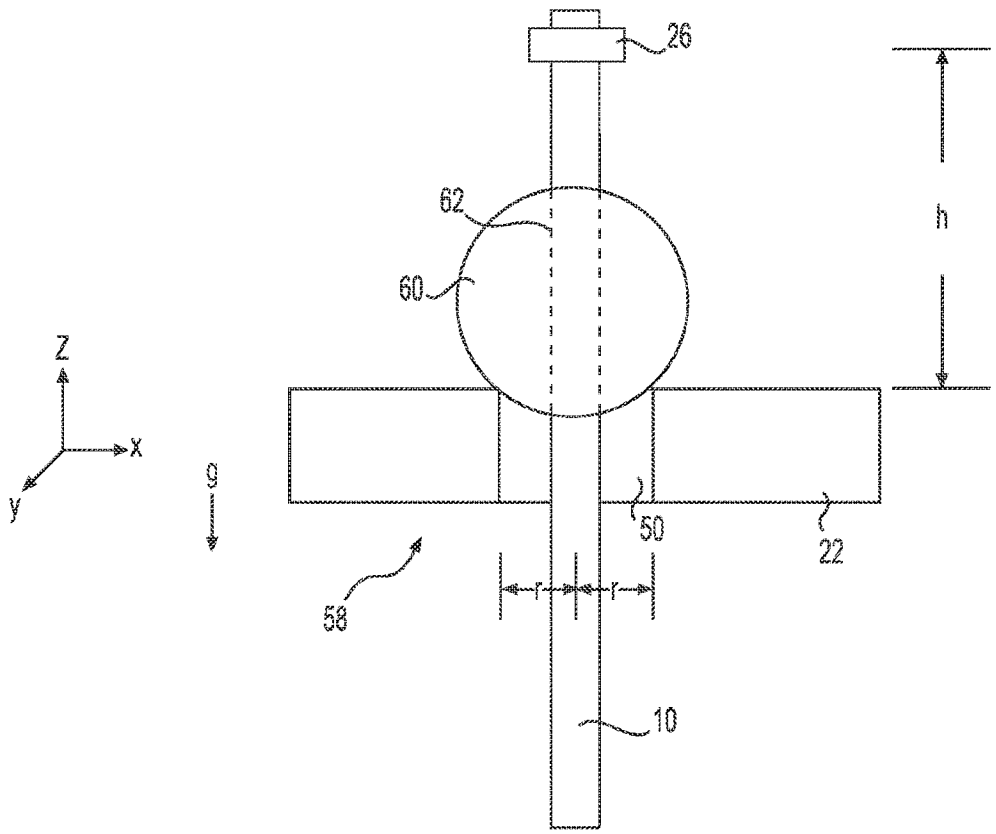
FIG. 13 is a graphical, side view of the positioner illustrated in FIG. 12, showing the positioner in second orientation.

With continued reference to FIGS. 12-14, one further feature associated with the rotary joint 58 is noted. In particular, the non-captive rotary pivot 60 is capable of moving with respect to the opening 50. As a result, the positioner 10 is capable of moving, in 360°, by a distance r from the initial position illustrated. Since the positioner 10 may move a distance r from the initial position, the positioner 10 may adjust for an extreme curvature of the mold 18 by shifting up to the distance r within the opening 50. As should be apparent from the illustrations, the opening 50 is contemplated to be circular and the distance r is a radius of the opening 50.

Figure 15:
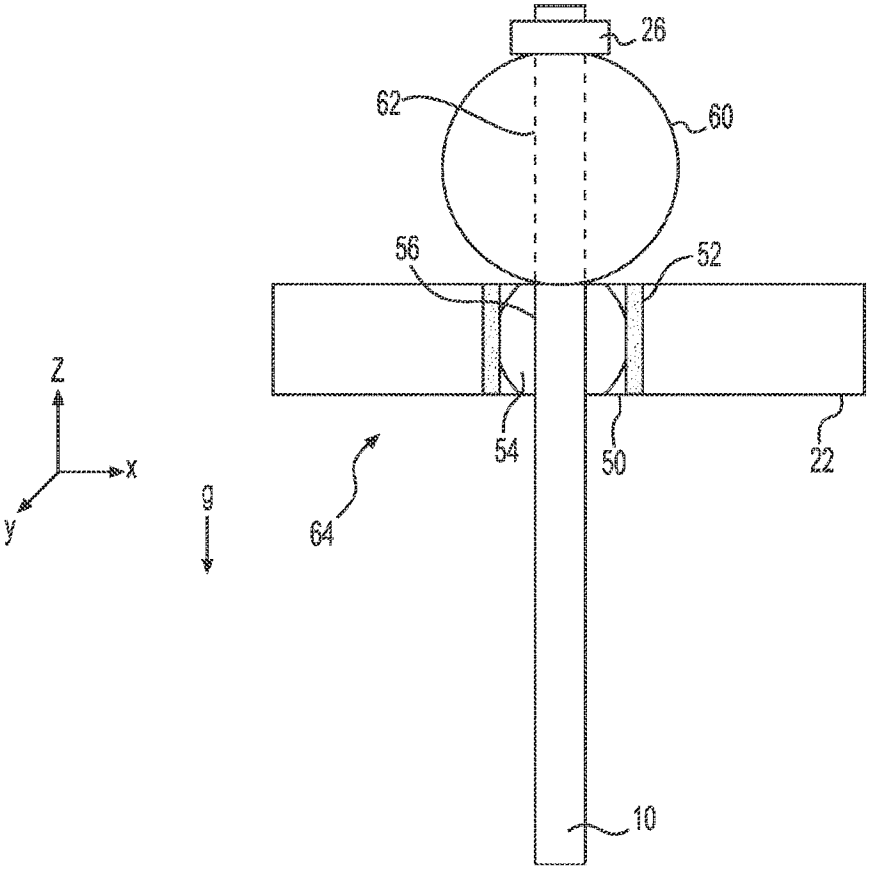
FIG. 15 is a graphical, side view of a third embodiment of a positioner connected to one of the fabric attractors forming the fabric handling array illustrated in FIG. 1, showing the positioner in a first orientation.

FIG. 15 is a graphical side view of a third contemplated embodiment of a rotary joint 64 (hereinafter also referred to generally as a joint) according to the present invention. This contemplated embodiment combines the captive rotary pivot 54 and the non-captive rotary pivot 60.

Figure 16:
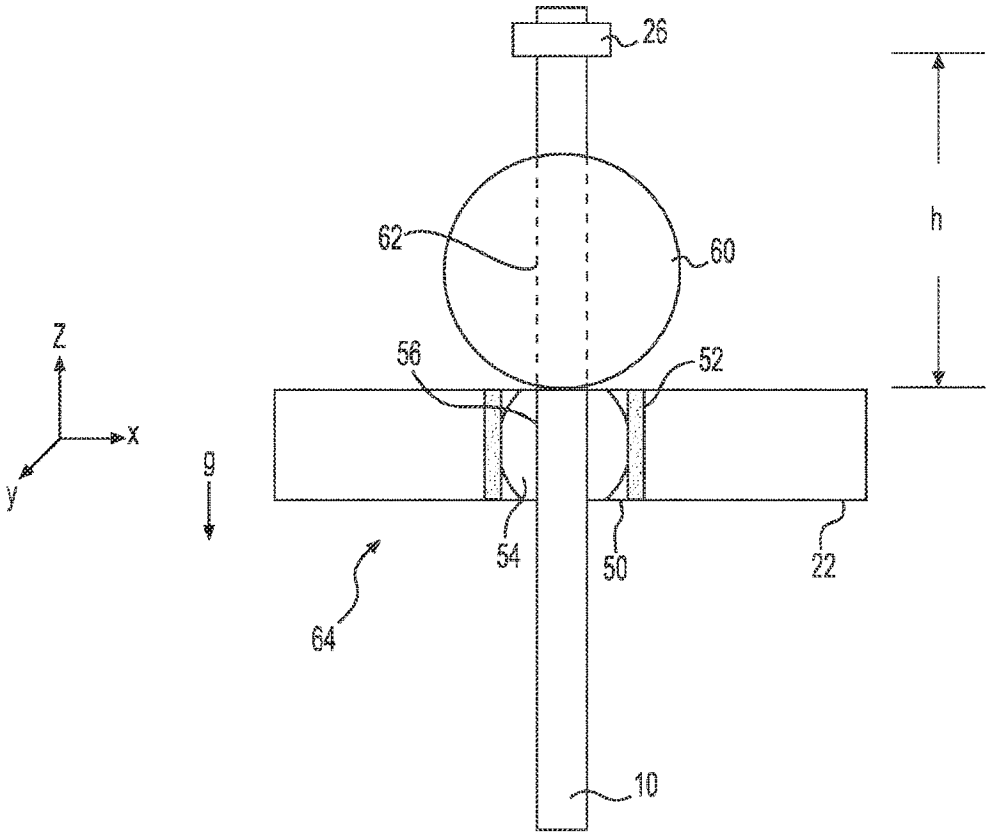
FIG. 16 is a graphical, side view of the positioner illustrated in FIG. 15, showing the positioner in second orientation.

FIG. 16 is a graphical side view of the rotary joint 64, with the positioner having been displaced a predetermined height h above the positioning plate 22.

Figure 17:
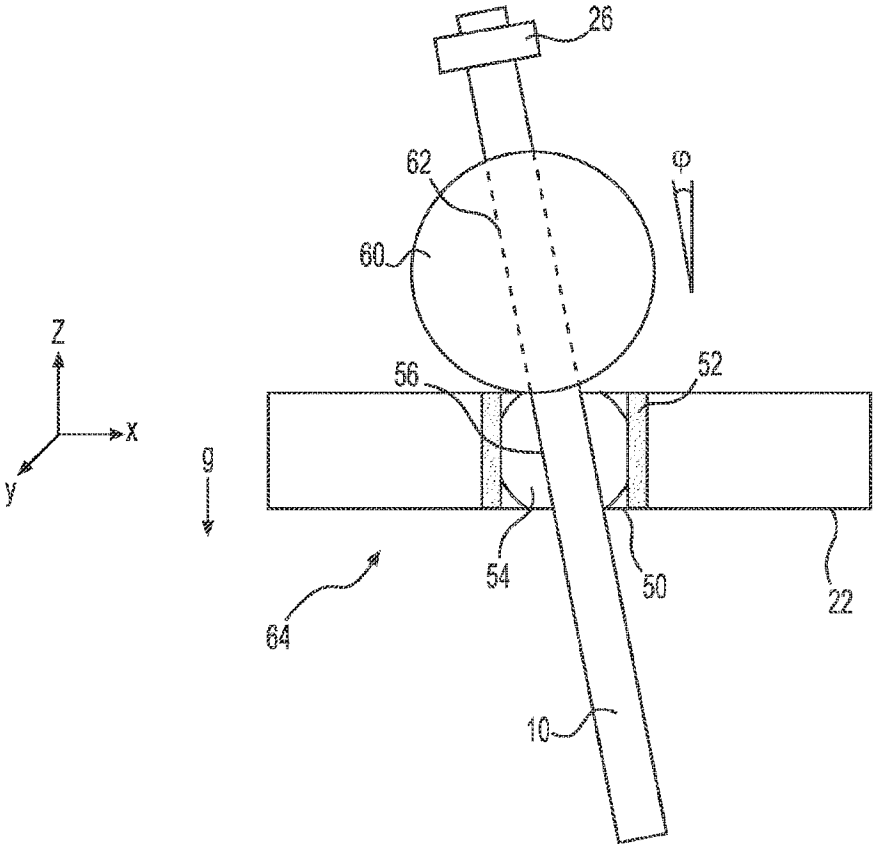
FIG. 17 is a graphical, side view of the positioner illustrated in FIG. 15, showing the positioner in a third orientation.

FIG. 17 illustrates the rotary joint 64, with the positioner 10 having been displaced at a predetermined angle φ with respect to the positioning plate 22.

FIG. 18 is a graphical top view of the array 12. At each intersection of connectors 28, a rotary joint 48, 58 or 64 is positioned. According to one embodiment of the present invention, all of the rotary joints 48, 58, 64 may share the same construction. In another contemplated embodiment, the rotary joints 48, 58, 64 may differ from one another. In other words, a combination of different rotary joints 48, 58, 64 may be employed without departing from the scope of the present invention.

To facilitate discussion of various contemplated embodiments of the array 12 illustrated in FIG. 18, the nine representative positions for the rotary joints 48, 58, 64 are labeled as A, B, C, D, E, F, G, H, I (hereinafter "A-I"). While it is contemplated that any of the rotary joints 48, 58, 64 may be placed at any of the positions A-I, there are three patterns for the rotary joints 48, 58, 64 that are specifically enumerated herein.

In a first contemplated embodiment, a captive rotary joint 48 is provided at each of the positions A-I. In a second embodiment, a non-captive rotary joint 58 is provided at each of the positions A-I. In a third embodiment, a captive rotary joint 48 or a rotary joint 60 is provided at position E and non-captive rotary pivots 58 are provided at the remaining positions A, B, C, D, F, G, H, I.

The second and third embodiments contemplate that the non-captive rotary joints 58 will permit the positioners 10 to move laterally within their respective, associated openings 50. In this manner, it is contemplated that the positioners 10 will be less likely to lock up (or bind) within individual ones of the openings 50 under circumstances where, for example, the mold 18 presents an extreme curvature to the positioners 10 on the array 12.

With continued reference to the second embodiment, it is contemplated that utilizing a captive rotary joint 48 at the central position E will help to keep the positioners 10 aligned generally with the array 12. In one contemplated variation, a rotary joint 64 may be employed at the position E in the instance where the remaining positions A, B, C, D, F, G, H, I include non-captive rotary joints 58. In this way, the rotary joint 64 and the non-captive rotary joint 58 are expected to behave in a similar manner, because they each include non-captive rotary pivots 60. Specifically, since each of the joints 58, 64 include the non-captive rotary pivots 60, the positioners 10 will have a uniform height during the period of transition from the layup table 16 to the mold 18.

While any possible combination of joints 48, 58, 64 may be employed for the array 12 at the positions A-I, the arrangement discussed in connection with the third embodiment of the array 12 is considered to be suitable for many applications of the array 12 of the present invention. As should be apparent, each non-captive rotary pivot 60 helps to center the associated positioner 10 in the associated opening 50. The non-captive rotary pivot 60 is contemplated to shift with respect to the opening 50 only in unusual or extreme circumstances. To discourage the array 12 of positioners 10 from becoming misaligned, the joints 48, 64 may be used in combination with the joints 58 in the manner discussed above.

As should be apparent, the positions A-I are merely representative of a much larger array 12 of positioners 10. As such, selected, predetermined patterns of joints 48, 58, 64 may be repeated across the entire array 12. As such, it is contemplated that the joints 48, 58, 64 may follow a repetitive pattern. Alternatively, the joints 48, 58, 64 may be unevenly distributed across the array 12 in non-repetitive pattern, as required or as desired.

With renewed reference to FIGS. 3 and 4, for example, it is noted that an arcuate plane represents one possible surface feature that may be presented to the attractors 20 by the surface of the mold 18. As should be apparent to those skilled in the art, a mold 18 for an aircraft wing, for example, will present a complex set of different surface configurations or contours to which the plurality of attractors 20 are required to adapt before depositing the fabric 14 thereon.

As discussed above, in the embodiment illustrated in FIGS. 1-3, adjacent ones of the attractors 20 are connected to one another via connectors 28. In the embodiment (and variations) illustrated in FIGS. 4-8, the attractors 20 are attached to or incorporated into the mat 42 (also referred to as a continuous sheet 42). The connectors 28, 42 maintain the attractors 20 in relation to one another regardless of the contour of the shape defined by the mold 18. As should be apparent from the foregoing, the connectors 28, 42 limit a differential in the height h between adjacent ones of the attractors 20 to within a predetermined range when the array 12, 40 is lowered onto the surface of the mold 18. This prevents the height h of any one attractor 20 from departing radically from the height h of any adjacent attractor 20. The connectors 28, 42 assure a smooth transition from one attractor 20 to the next and, accordingly, assure a smooth contouring of the fabric handling array 12 across the surface of the mold 18.

As should be apparent, the connectors 28, 42 ensure that the three-dimensional distance between adjacent attractors 20 remains substantially constant. In other words, the connectors 28, 42 establish a substantially constant positional relationship between the attractors 20. In this regard, the connectors 28, 42 are considered to exhibit substantially no elongation or compression properties. If the connectors 28, 42 were permitted to stretch or compress, a substantially uniform three-dimensional distance between adjacent attractors 20 would be more difficult to maintain.

As noted above, the present invention is described in connection with one or more embodiments thereof. The embodiments are intended to be illustrative of the breadth of the present invention. Focus on any one particular embodiment is not intended to be limiting thereof. The present invention, therefore, is intended to encompass variations and equivalents, as would be appreciated by those skilled in the art.

What is claimed is:

1. A positional adjustment apparatus for an attractor, comprising:

a position plate disposable at least adjacent to a surface of a mold;

at least one drive operatively connected to the positioning plate to move the positioning plate and alter at least one of a first height, a first angle of tilt, a first lateral position, and a rotational position of the positioning plate with respect to the surface of the mold;

at least one positioner disposed in each opening through the positioning plate, the at least one positioner hanging from and being moveable independently of the positioning plate;

at least one attractor connected to the at least one positioner; and a joint disposed between each at least one positioner and the positioning plate, the joint permitting the at least one positioner to change at least one of a second height, a second angle of tilt, and a second lateral position with respect to the positioning plate, wherein each joint comprises a sleeve disposed within each opening in the positioning plate, a first rotary pivot captively disposed within each sleeve, and a second rotary pivot non-captively disposed above each opening in the positioning plate, wherein each at least one positioner is slidably disposed through a first hole in each first rotary pivot and each at least one positioner is slidably disposed through a second hole in each second rotary pivot, permitting adjustment of the second height of each at least one positioner with respect to the positioning plate, and wherein each first rotary pivot is rotatable within each sleeve, permitting adjustment of the second angle of the at least one positioner with respect to the positioning plate.

2. The positional adjustment apparatus of claim 1, wherein the positioning plate comprises:

a planar sheet defining a plurality of openings therein.

3. The positional adjustment apparatus of claim 1, wherein the positioning plate comprises:

a truss having a plurality of openings therein.

4. The positional adjustment apparatus of claim 1, wherein the at least one drive connects to the positioning plate.

5. The positional adjustment apparatus of claim 1, wherein the at least one positioner comprises a plurality of positioners and the at least one attractor comprises a plurality of attractors, each positioner comprises a cap at a top end, preventing each positioner from falling through each opening in the positioning plate, and each positioner includes one of the plurality of attractors attached at a bottom end.

6. The positional adjustment apparatus of claim 5, wherein each attractor comprises a suction cup.

7. The positional adjustment apparatus of claim 5, wherein each attractor comprises an electrostatic element.

8. The positional adjustment apparatus of claim 1, wherein each at least one positioner comprises a rod made from a material selected from the group comprising steel, metals, metal alloys, plastic, thermoplastic materials, composite materials, nylon, polytetrafluoroethylene, aramid composites, ceramics, and cellulosic materials.

9. The positional adjustment apparatus of claim 1, wherein the first and second rotary pivots are spherical.

10. The positional adjustment apparatus of claim 1, wherein the at least one positioner comprises a plurality of positioners and the at least one attractor comprises a plurality of attractors, the positional adjustment apparatus further comprising:

a connector connecting adjacent attractors to one another.

11. The positional adjustment apparatus of claim 10, wherein the connector comprises a plurality of rods connected to one another, end to end, via joints.

12. The positional adjustment apparatus of claim 10, wherein the connector comprises a flexible rod.

13. The positional adjustment apparatus of claim 10, wherein the connector comprises a flexible sheet.

* * * * *